United States Patent [19]

Debaigt

[11] 4,099,821

[45] Jul. 11, 1978

[54] ELECTRIC CONNECTION BLOCK WITH MULTIPLE CIRCUITS

[75] Inventor: Jean Debaigt, Maisons Laffitte, France

[73] Assignee: CGEE Alsthom S.A., Levallois-Perret, France

[21] Appl. No.: 771,488

[22] Filed: Feb. 24, 1977

[30] Foreign Application Priority Data

Mar. 3, 1976 [FR] France ..... 76 06009

[51] Int. Cl.[2] ..... H01R 9/14; H01R 13/54; H01R 13/58

[52] U.S. Cl. ..... 339/91 R; 339/198 R; 339/198 J

[58] Field of Search ..... 339/91 R, 176 M, 198 R, 339/198 E, 198 G, 198 GA, 198 J, 198 P, 276 A

[56] References Cited

U.S. PATENT DOCUMENTS

| | | | |
|---|---|---|---|
| 3,325,770 | 6/1967 | Hammell | 339/176 M |
| 3,412,367 | 11/1968 | Churla | 339/91 R |
| 3,718,889 | 2/1973 | Bartlett | 339/198 J |
| 3,740,697 | 6/1973 | Van Son | 339/276 A |
| 3,753,216 | 8/1973 | Johnson | 339/198 GA |
| 3,777,223 | 12/1973 | Chandler | 339/198 R |
| 3,829,821 | 8/1974 | Derr | 339/91 R |
| 3,920,309 | 11/1975 | Garver | 339/198 G |
| 3,950,060 | 4/1976 | Stipanuk | 339/91 R |

*Primary Examiner*—Neil Abrams

*Attorney, Agent, or Firm*—Sughrue, Rothwell, Mion, Zinn and Macpeak

[57] ABSTRACT

An electric connection block comprising a base carrying rows of contact pins, wherein this base carries two guide bars made of insulating material, disposed at the ends of the rows of contact pins at a distance from the ends of these rows so as to form wiring channels and also provide a support for the contact plugs or a protective hood.

3 Claims, 6 Drawing Figures

ELECTRIC CONNECTION BLOCK WITH MULTIPLE CIRCUITS

FIELD OF THE INVENTION

The invention relates to an electric connection block which enables connections to be made to a plurality of circuits, and more precisely, to an electric connection block in which a base carrying rows of contact pins can accommodate various connections such as point-to-point clip connections, wound connections or plugs with female contact elements.

BACKGROUND OF THE INVENTION

There are difficulties in producing such a connection block. The passages for numerous conductors and the protection of these conductors are difficult to form. It is useful in some applications to be able to effect on the same contact pins point-to-point connections and/or wound connections and also plug connections simultaneously.

Preferred embodiments of the present invention provide dispositions of wiring channels and developments of the basic disposition for facilitating the exit of projecting conductors, for ensuring their protection, for installing plug connections or for fixing block on a support.

SUMMARY OF THE INVENTION

Thus the present invention provides an electric connection block having multiple circuits, comprising a base carrying rows of contact pins which are parallel to one another. If contact pins have free ends on one side of the base, wherein this base carries on either side at its end and at a distance two guide bars made of insulating material which are parallel to the contact pins and perpendicular to the rows and wherein said guide bars are fitted in their region far from the base with one of two parts of a fixing device whose other part is carried by a member made of insulating material and installed on the end of the guide bars on the side of the base which has the free ends of the contact pins.

The guide bars, which can be added to a base or constitute a single piece with this base, define wiring channels between themselves and the ends of the rows of contact pins.

The guide bars, instead of being solid, are advantageously slotted in a comb configuration to form wire outlets.

One of the guide bars can be used for fixing the connection block on a support such as a channel section bar. It is then fitted on its opposite surface to the one facing the contact pins, with a fixing leg.

The member fitted to the end of the guide bars on the opposite side to the base, may be a contact plug or a protective hood. The guide bars are fitted for this purpose in their region which is furthest from the base with one of the two parts of a fixing device the other part of which is carried by the member fitted on the ends of the guide bars.

The guide bars are preferably rigid and the member fitted on the end carries elastically said other part of the fixing device. In the case of a protective hood, the thinness of this hood can give naturally the required elasticity, while in the case of a contact plug, a slot separates this other part of the fixing device from the rest of the plug so as to impart elasticity to it.

In the fixed position of the contact plug, the female contact elements of the contact plug accommodate the end of the contact pins of the base, but leave a great length of these contact pins available for other connections.

The positive hood can allow a wiring harness, leaving the block in a direction parallel to the contact pins, to pass through the central orifice of the protective hood. It is then advantageously formed by two parts succeeding each other in a direction parallel to the planes of the rows of contact pins and assembled by screws, this making it possible to install the hood after wiring. This wiring harness can be clamped by a device provided with two screws which are parallel to the rows of contact pins and installed on each other of the two parts forming the protective hood.

Non-limiting embodiments of the invention are described hereinbelow by way of example with reference to the accompanying drawings.

DESCRIPTION OF PREFERRED EMBODIMENTS

Figure 1:
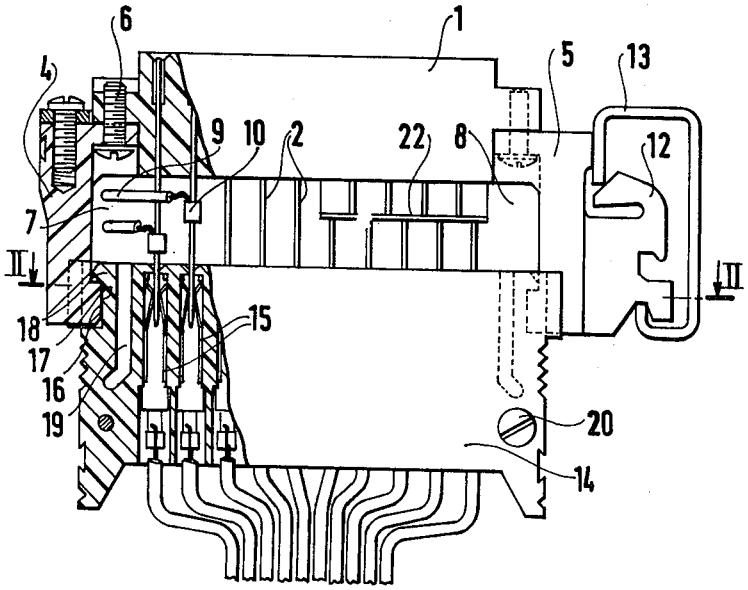
FIG. 1 is a partial cross-section of an electric connection block with a contact plug.
Figure 6:
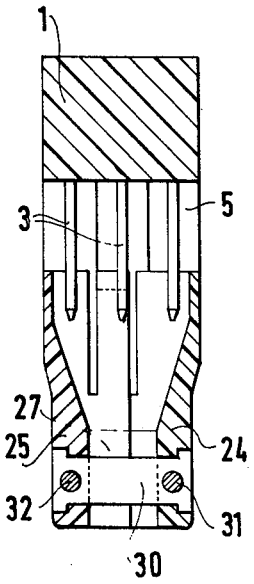
FIG. 6 is a cross-section along line VI—VI of FIG. 4.
Figure 5:
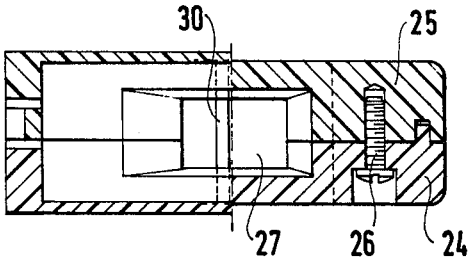
FIG. 5 is a cross-section along line V—V of FIG. 4.

In both these examples; the electric connection block comprises a base 1 carrying rows of contact pins 2. These rows 3, of which there are three, for example, are shown in FIG. 6. The base 1 carries two guide bars 4 and 5 made of insulating material which it has been assumed here are distinct from the base and fixed thereon by screws 6. These guide bars 4 and 5 leave empty spaces 7 and 8 at the end of the rows 3 of contact pins, these empty spaces being used as wiring channels; FIG. 1 shows by way of example conductors 9 connected to the contact pins by clips 10 and fitting into the channel 7.

Figure 3:
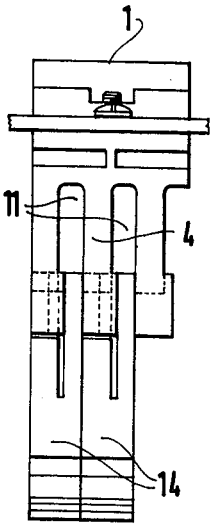
FIG. 3 shows the end of the block of FIG. 1.

The guide bars 3 and 5 can be slotted in a comb configuration as in FIG. 3 where the guide bar 4 has slots 11 for the conductors to pass through.

FIG. 1 shows the guide bar 5 fitted with a fixing leg 12 clipped in support channel section bar 13.

Figure 2:
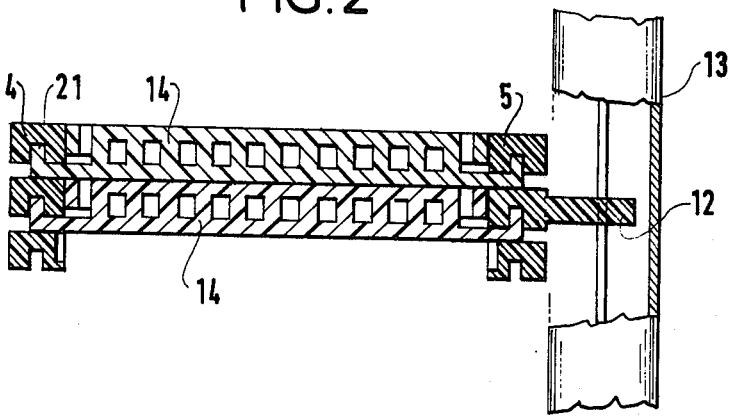
FIG. 2 is a cross-section along line II—II of FIG. 1.

In the example of FIG. 1, the guide bars 4 and 5 serve as supports and as holding elements for conductor support members or contact plugs 14. In this example, each contact plug 14 carries, in a mass of insulating material, a single row of female contact elements 15 each intended to accommodate one of the contact pins 2 of a row 3. Each plug 4 has a notch 16 at each of the end of its row of contact elements 15. When the plug is in place these notches 16 are intended to accommodate teeth 17 carried by the guide bars 4 and 5 in the zone distant from the base 1 and on those surfaces of the guide bars which face each other. Each notch 16 is carried by a tongue 18 made elastic by a slot 19 which separates it from the rest of the plug. Several plugs 14 can be assembled together, for example by screws 20 shown in FIG. 1. Each plug 14 carries on one side a rail 21 shown in FIG. 2 which fits into a groove of one of the guide bars 4 and 5 and which prevents insertion of the plug if the plug is turned at 180° in relation to its normal position.

The holding of the contact plugs 14 by the guide bars 4 and 5 ensures contact between the contact elements 15 and the free ends of the contact pins 2 and it leaves free a great part of the length of these contact pins which can accommodate various connections such as the clips 10, wound connections or shunt bars 22.

Figure 4:
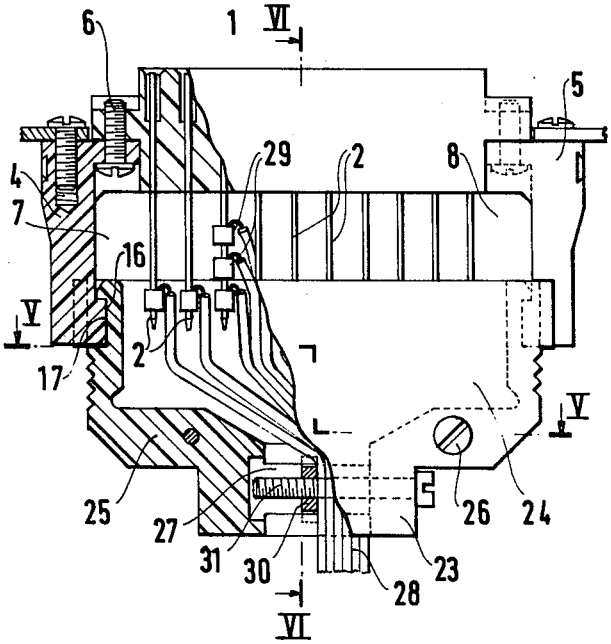
FIG. 4 is a partial cross-section of an electric connection block with a protective hood.

In the example of FIG. 4, the guide bars 4 and 5 act as supports and holding elements for a single conductor support member or protective hood 23 formed by two parts 24 and 25 assembled by screws 26. These two parts are installed on the guide bars 4 and 4 by means of a fixing device with a notch 16 and a tooth 17 identical to the devices for fixing the plugs 14 on the guide bars. This hood 23 comprises a central orifice 27 allowing a wiring harness 28 to pass which is connected to the contact pins 2 by point-to-point connections 29. This wiring harness is clamped by a device comprising a strip 30 pulled by two screws 31, 32 disposed respectively in the parts 24 and 25. In the example illustrated the hood 23 has a width corresponding to three rows of contact pins.

I claim:

1. An electric connection block having multiple circuits, said block comprising: a base carrying multiple rows of contact pins which are parallel to one another and have free ends projecting outwardly from one side of the base, said base carrying at both ends and to said one side guide bars of insulating material, said guide bars being parallel to the contact pins and perpendicular to the rows and being spaced laterally from the contact pins at respective ends of said rows, a plurality of plugs in side abutting contact and spanning between said guide bars for carrying conductors to be electrically connected to the projecting ends of said contact pins, each plug receiving contact pins of a given row, said guide bars bein slotted in a comb configuration and forming spaced portions faing away from said base, and means for interfitting the ends of said plugs respectively to the ends of respective guide bar portions remote from said base with said base, said guide bars and said plugs defining wiring channels at the ends of the rows of contact pins, to permit conductors to extend through said guide bar slots and wherein said plugs are spaced sufficiently from said base to provide an extended free length to the contact pins to allow conductors connections to respective contacts pins of said rows with said plugs being individually supported by opposed aligned portions of said guide bars as defined by said comb slots.

2. An electric connection block according to claim 1, wherein said guide bars are rigid and terminate at their outer ends in teeth on the surfaces of said guide bars which face each other, said plugs include slots adjacent the ends which extend parallel to the contact pins and form elastic tongues at respective ends of said plugs with each tongue being provided with a notch matching the tooth of its respective guide bar portion and being interfittingly connected thereto such that said plugs are elastically carried in side abutting contact at the ends of respective guide bar portions separated by said comb slots.

3. An electric connection block having multiple circuits, said block comprising: a base carrying multiple rows of contact pins which are parallel to one another and have free ends projecting outwardly from one side of the base, said base carrying at both ends and to said one side guide bars of insulating material, said guide bars being parallel to the contact pins and perpendicular to the rows and being spaced laterally from the contact pins at respective ends of said rows, a protective hood spanning between said guide bars, said protective hood being formed by two interconnected parts which envelope the rows of contact pins in a direction perpendicular to the planes of rows of contact pins and being separable in a plane parallel to the rows of contact pins, screws for maintaining said two parts assembled together, said protective hood including means defining a central orifice for receiving a wiring harness, said block further comprising a clamping device for clamping the wiring harness to the protective hood at the central orifice, said parts carrying, respectively, elongated, aligned slots at said orifice, a strip being positioned within said slots and passing through said orifice and second screws mounted to said parts and threaded to said strip on opposite sides of said orifice for causing said strip to compress said wiring harness against said hood parts for fixing said wire harness to said hood, said guide bars being slotted in a comb configuration and forming spaced portions facing away from said base, teeth on the surface of the guide bar portions which face each other at their outer ends and interengaging notches on said hood parts on the surfaces facing said guide bar portions and receiving the teeth of said guide bar portions; whereby, conductors extending through the guide bar slots may be connected to respective contact pins of said rows with said hood parts being individually supported by respective guide bar portions as defined by said comb slots.

* * * * *